US011661726B2

(12) United States Patent
Nagata et al.

(10) Patent No.: US 11,661,726 B2
(45) Date of Patent: May 30, 2023

(54) TOOTH ATTACHMENT STRUCTURE FOR BUCKET AND TOOTH FOR BUCKET

(71) Applicant: KOMATSU LTD., Tokyo (JP)

(72) Inventors: Takanori Nagata, Tokyo (JP); Daijirou Tanaka, Tokyo (JP); Yudai Furudate, Tokyo (JP); Tatsuo Aira, Tokyo (JP); Monta Kondou, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/636,456

(22) PCT Filed: Sep. 9, 2020

(86) PCT No.: PCT/JP2020/034163
§ 371 (c)(1),
(2) Date: Feb. 18, 2022

(87) PCT Pub. No.: WO2021/049543
PCT Pub. Date: Mar. 18, 2021

(65) Prior Publication Data

US 2022/0298758 A1 Sep. 22, 2022

(30) Foreign Application Priority Data

Sep. 13, 2019 (JP) ..... JP2019-167277

(51) Int. Cl.
*E02F 9/28* (2006.01)

(52) U.S. Cl.
CPC ..... *E02F 9/2833* (2013.01); *E02F 9/2825* (2013.01)

(58) Field of Classification Search
CPC ..... E02F 9/2825; E02F 9/2833
See application file for complete search history.

(56) References Cited

U.S. PATENT DOCUMENTS 3,952,433 A * 4/1976 Heinold ..... E02F 9/2841 24/581.1
4,823,486 A 4/1989 Diekevers et al.
(Continued)

FOREIGN PATENT DOCUMENTS

CA 2 312 550 A1 12/2001
CN 101535574 A 9/2009
(Continued)

OTHER PUBLICATIONS

The International Search Report for the corresponding international application No. PCT/JP2020/034163, dated Dec. 1, 2020.
(Continued)

*Primary Examiner* — Gary S Hartmann
(74) *Attorney, Agent, or Firm* — Global IP Counselors, LLP

(57) ABSTRACT

A tooth attachment structure for a bucket includes a tooth, a pin member, and a lock member. The tooth includes a guide groove provided on an inner surface of the tooth and a pin hole provided in the guide groove. The pin member is disposed in the pin hole. The lock member is disposed in the guide groove. The lock member locks the pin member. The lock member engages the pin member by sliding toward the pin member.

14 Claims, 16 Drawing Sheets

(56) References Cited

U.S. PATENT DOCUMENTS

| | | | | |
|---|---|---|---|---|
| 5,177,886 | A * | 1/1993 | Klett | E02F 9/2825 37/456 |
| 5,704,100 | A | 1/1998 | Swan | |
| 6,708,431 | B2 * | 3/2004 | Robinson | E02F 9/2825 37/456 |
| 8,397,405 | B2 | 3/2013 | Harder et al. | |
| 9,476,184 | B2 * | 10/2016 | Wallis | E02F 9/2841 |
| 9,512,599 | B2 * | 12/2016 | Rol Corredor | E02F 9/2841 |
| 10,053,839 | B2 * | 8/2018 | Serrurier | E02F 9/2833 |
| 10,106,961 | B2 * | 10/2018 | Rol Corredor | E02F 9/2858 |
| 10,494,793 | B2 * | 12/2019 | Serrurier | E02F 9/2858 |
| 10,907,328 | B2 * | 2/2021 | Ortiz Garcia | E02F 9/2858 |
| 11,427,991 | B2 * | 8/2022 | Ortiz Garcia | E02F 9/2858 |
| 2004/0216336 | A1 | 11/2004 | Briscoe | |
| 2013/0333254 | A1 | 12/2013 | Wallis et al. | |
| 2014/0223786 | A1 | 8/2014 | Rol Corredor et al. | |
| 2017/0226718 | A1 | 8/2017 | Snyder | |
| 2018/0171602 | A1 | 6/2018 | Quarfordt et al. | |

FOREIGN PATENT DOCUMENTS

| | | | |
|---|---|---|---|
| CN | 102704529 | A | 10/2012 |
| CN | 202627065 | A | 12/2012 |
| CN | 104105830 | A | 10/2014 |
| CN | 206034531 | U | 3/2017 |
| CN | 108699818 | A | 10/2018 |
| JP | 57-9931 | A | 1/1982 |
| JP | 2000-104293 | A | 4/2000 |
| JP | 2001-355258 | A | 12/2001 |
| JP | 2007-9631 | A | 1/2007 |
| JP | 2012-72658 | A | 4/2012 |
| JP | 2014-518342 | A | 7/2014 |
| JP | 2018-518618 | A | 7/2018 |

OTHER PUBLICATIONS

Office Action for the corresponding Chinese application No. 202080058970.0, dated Jun. 22, 2022.

* cited by examiner

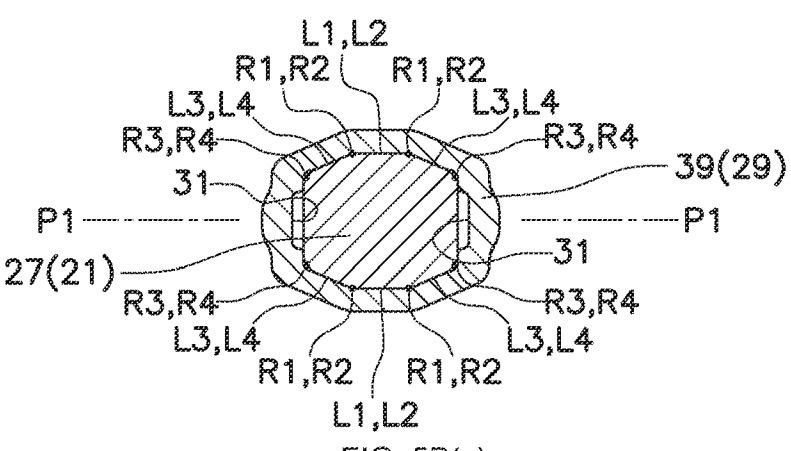
FIG. 5B(c)
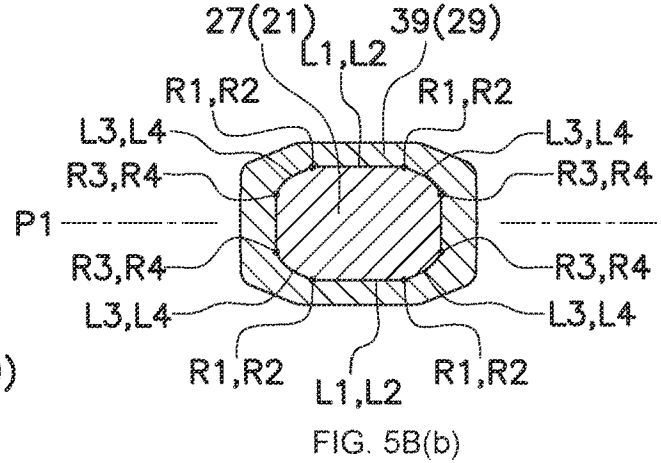
FIG. 5B(b)
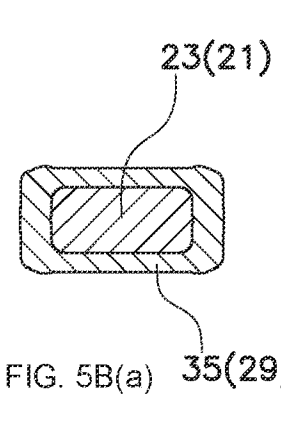
FIG. 5B(a)
FIG. 5B(e)
FIG. 5B(d)

TOOTH ATTACHMENT STRUCTURE FOR BUCKET AND TOOTH FOR BUCKET

CROSS-REFERENCE TO RELATED APPLICATIONS

This application is a U.S. National stage application of International Application No. PCT/JP2020/034163, filed on Sep. 9, 2020. This U.S. National stage application claims priority under 35 U.S.C. § 119(a) to Japanese Patent Application No. 2019-167277, filed in Japan on Sep. 13, 2019, the entire contents of which are hereby incorporated herein by reference.

BACKGROUND

The present invention relates to a tooth attachment structure for a bucket and a tooth for a bucket.

BACKGROUND INFORMATION

As a prior art, JP2007-9631A (Japanese published unexamined patent application) discloses a tooth attachment structure for a bucket. In a conventional tooth attachment structure for the bucket, a tooth and a tooth adapter are connected via a pin member. In this case, the pin member is locked by engaging a retainer with the pin member.

In the conventional tooth attachment structure for the bucket, the tooth and the tooth adapter are connected by inserting the pin member into pin holes of the tooth and the tooth adapter in a state where the retainer disposed between the tooth and the tooth adapter.

In this case, it is difficult to mount the pin member to the tooth and the tooth adapter because a frictional resistance is large when the pin member passes through the retainer. Also, it is difficult to remove the pin member from the tooth and the tooth adapter when the tooth is replaced.

An object of the present invention is to provide a tooth attachment structure for a bucket in which a tooth can be easily mounted and dismounted. Also, an object of the present invention is to provide a tooth for a bucket which can be easily mounted to and dismounted from a mounting object.

SUMMARY OF THE INVENTION

A tooth attachment structure for a bucket according to a first aspect includes a tooth, a pin member, and a lock member. The tooth includes an internal space, a guide groove provided on an inner surface, and a pin hole provided in the guide groove. The pin member is disposed in the pin hole. The lock member locks the pin member. The lock member is disposed in the guide groove. The lock member engages with the pin member by sliding toward the pin member.

A tooth for a bucket according to a second aspect includes a tooth body, a guide groove, and a pin hole. The tooth body includes an internal space. The guide groove is provided on an inner surface of the tooth body. The pin hole is provided in the guide groove.

A tooth attachment structure for a bucket of the present invention can allow a tooth to be easily mounted and dismounted. Also, a tooth for a bucket of the present invention can easily mount to and dismount from a mounting object.

BRIEF DESCRIPTION OF THE DRAWINGS

FIGS. 5B(a)-B(e) are sectional views of the tooth attachment structure in the embodiment (cutting lines (a)-(e) of FIG. 5A).

DESCRIPTION OF EMBODIMENTS

Figure 1:
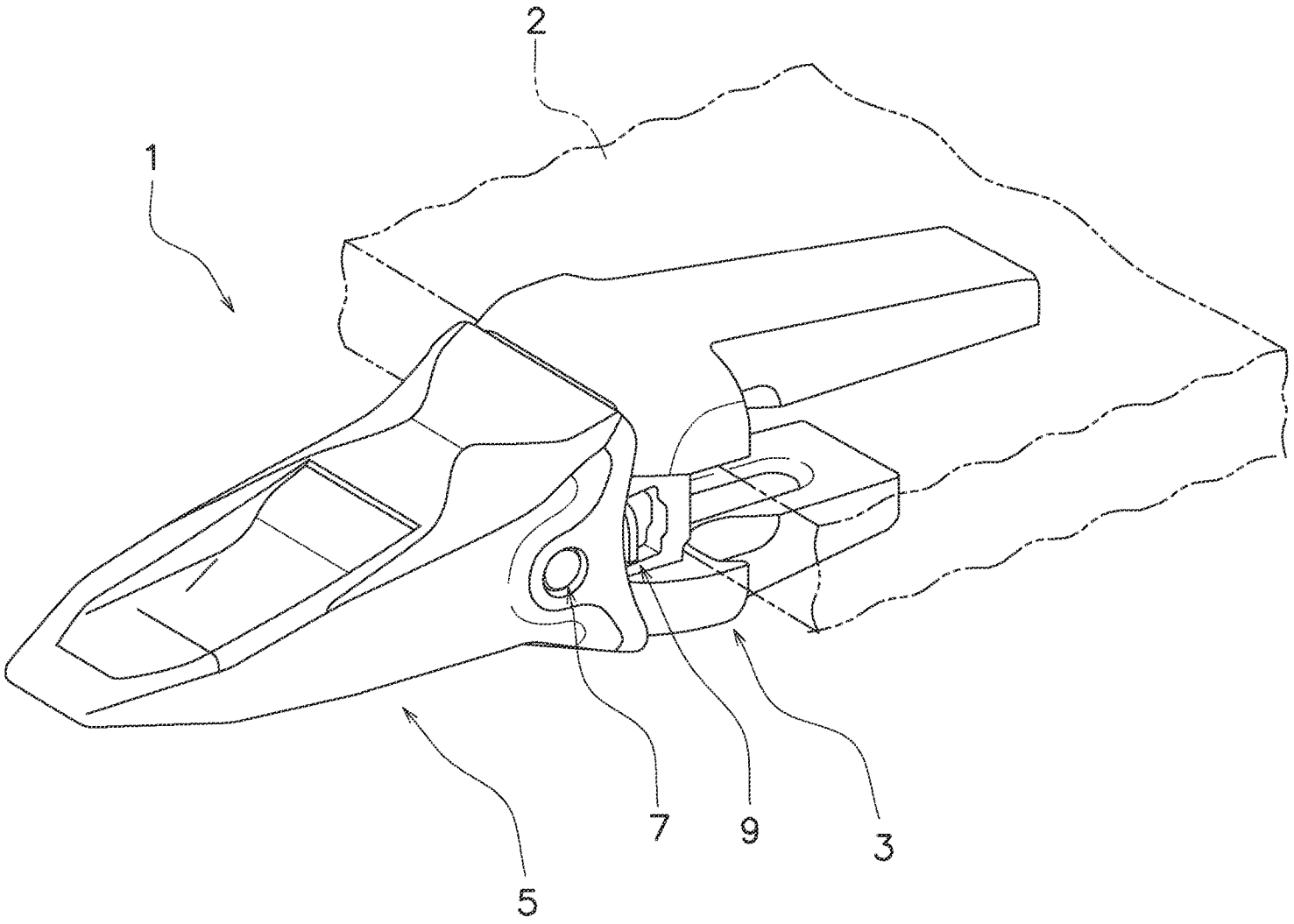
FIG. 1 is a perspective view of a tooth attachment structure for a bucket according to an embodiment.

Configuration of a tooth attachment structure 1 for a bucket according to the present embodiment will be described with reference to drawings. For example, as shown in FIG. 1, the tooth attachment structure 1 is mounted on a bucket 2. The tooth attachment structure 1 includes a tooth 5, a pin member 7, and a lock member 9. Specifically, the tooth attachment structure 1 includes a tooth adapter 3, the tooth 5, the pin member 7, and the lock member 9.

(Tooth Adapter)

Figure 2:
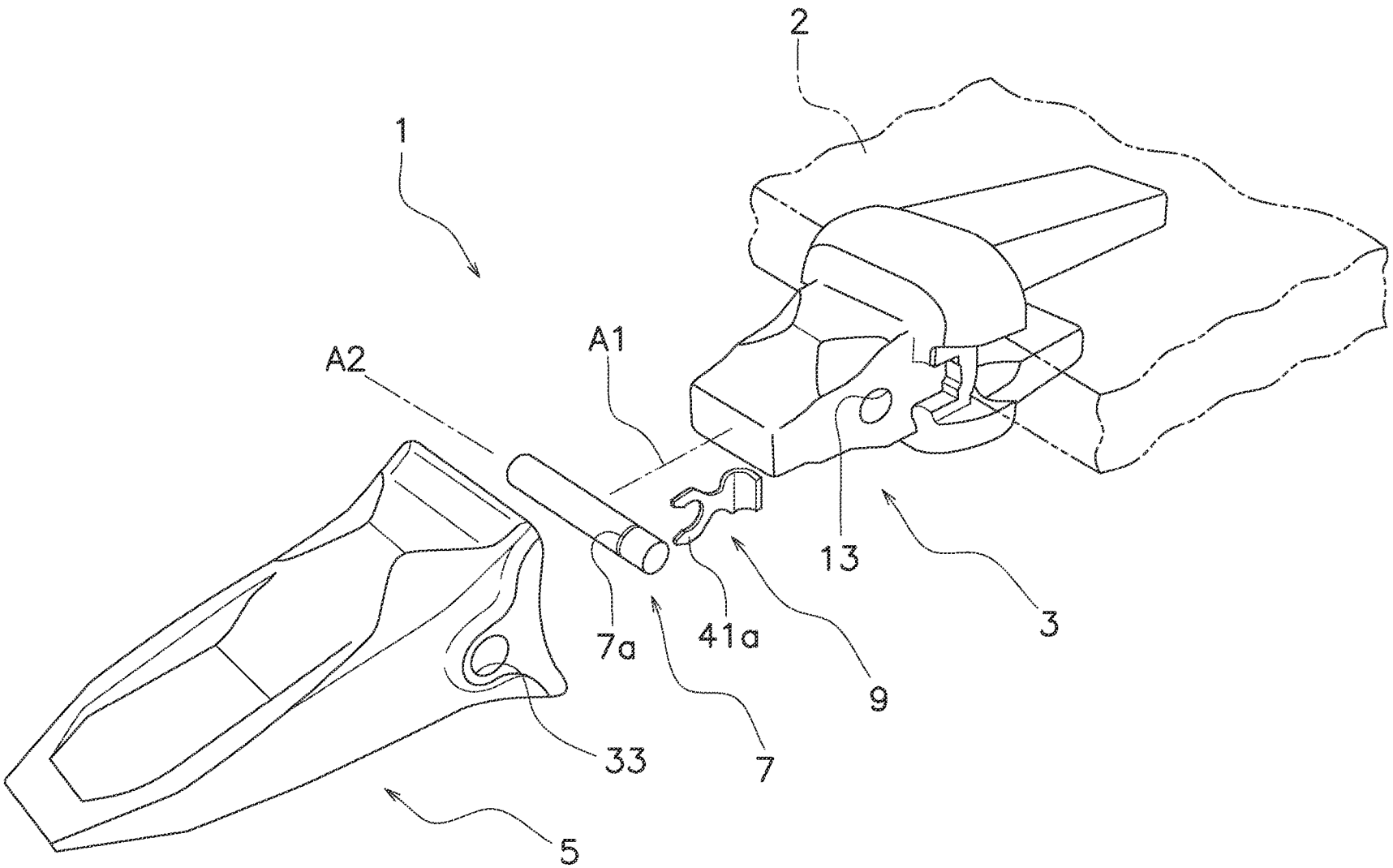
FIG. 2 is an exploded perspective view of the tooth attachment structure in the embodiment.

As shown in FIG. 1, the tooth adapter 3 is provided in the bucket 2. As shown in FIG. 2, the tooth adapter 3 is mounted to the bucket 2 so as to protrude from an opening of the bucket 2. The tooth adapter 3 is a member that is long in one direction. For example, as shown in FIG. 2, a longitudinal direction of the tooth adapter 3 corresponds to a direction in which an axis A1 extends. The axis A1 corresponds to a longitudinal direction of a nose portion 21 (described later).

Figure 3:
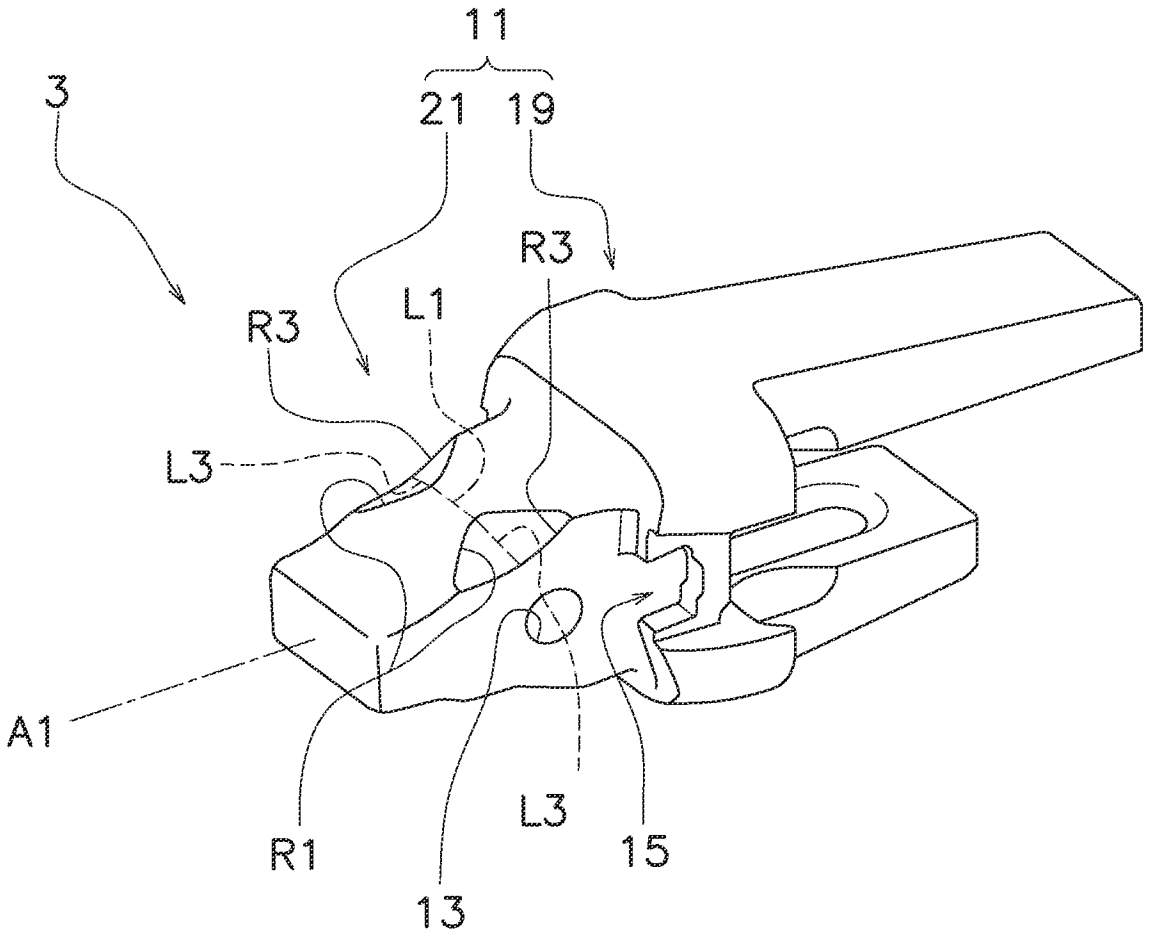
FIG. 3 is a perspective view of a tooth adapter in the embodiment.
Figure 4A:
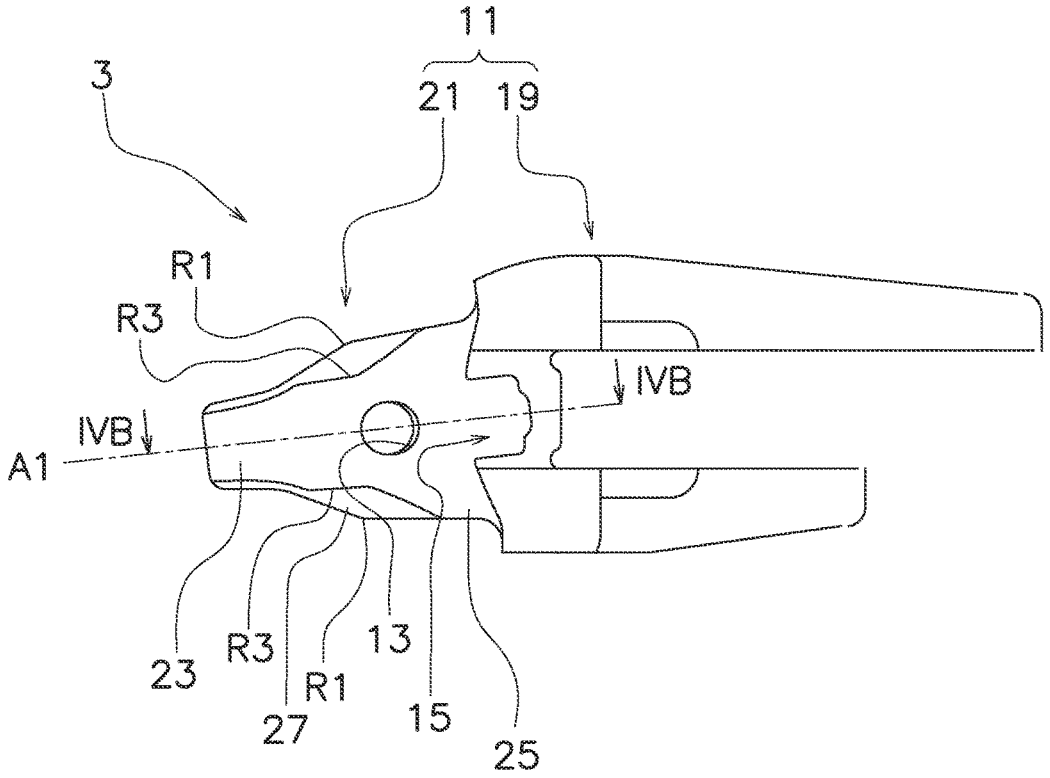
FIG. 4A is a side view of the tooth adapter in the embodiment.

As shown in FIG. 3, the tooth adapter 3 includes an adapter body 11, a first pin hole 13 (an example of a through hole), and a recess portion 15. As shown in FIG. 4A, the first pin hole 13 extends in a direction orthogonal to the axis A1 of the tooth adapter 3. A pin member 7 (see FIG. 2) is disposed in the first pin hole 13.

Figure 4B:
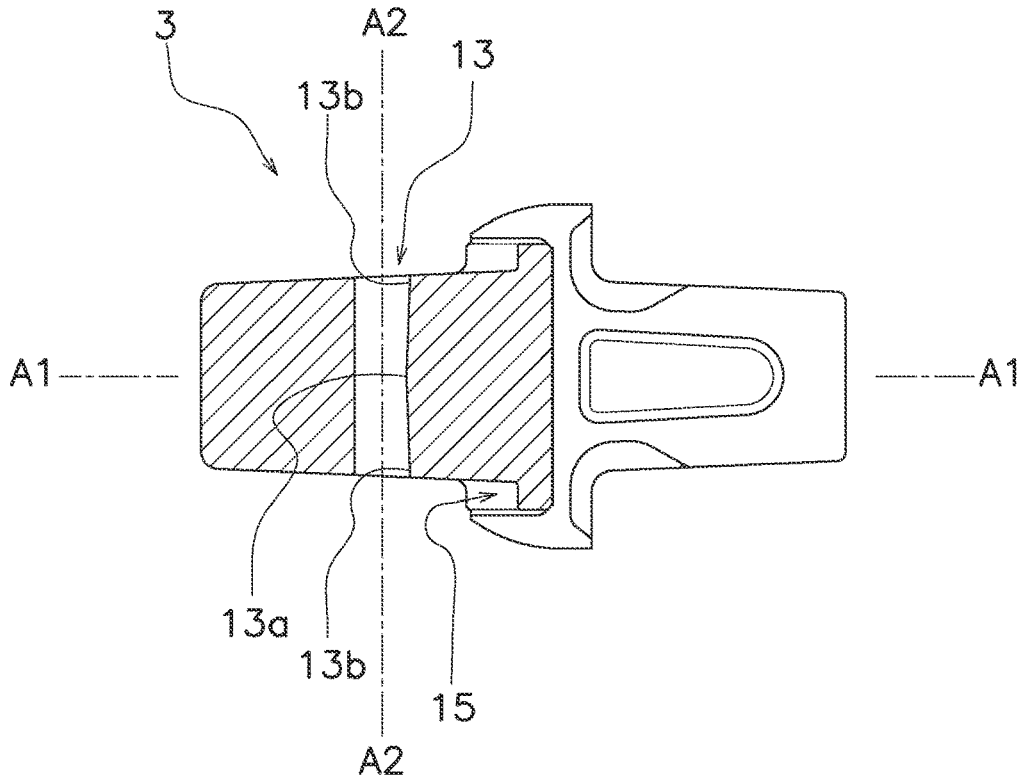
FIG. 4B is a sectional view for explaining a through hole of the tooth adapter in the embodiment (a cutting line IVB-IVB of FIG. 4A).

As shown in FIG. 4B, an end portion 13*b* of the first pin hole 13 has a larger diameter than a center portion 13*a* of the first pin hole 13. For example, an inner peripheral surface of the center portion 13*a* of the first pin hole 13 is formed in a circular shape. A diameter of the center portion 13*a* of the first pin hole 13 is larger than a diameter of the pin member 7. An inner peripheral surface of the end portion 13*b* of the first pin hole 13 is formed in a circular shape.

As shown in FIGS. 3 and 4A, the recess portion 15 is formed on a surface on which the first pin hole 13 of the tooth adapter 3 is formed. The lock member 9 is disposed in the recess portion 15 (see FIG. 7B). For example, a part of the lock member 9 is disposed in the recess portion 15.

Specifically, the tooth adapter 3 includes a mounting portion 19 and a nose portion 21. The mounting portion 19 and the nose portion 21 configures the adapter body 11. The mounting portion 19 is fixed to the bucket 2. The recess portion 15 is formed in the mounting portion 19.

The nose portion 21 extends from the mounting portion 19. For example, the nose portion 21 is integrally formed with the mounting portion 19. The nose portion 21 protrudes from the mounting portion 19 so as to be away from the bucket 2. The nose portion 21 is formed in a tapered shape. The nose portion 21 is a member that is long in one direction. The longitudinal direction of the nose portion 21 corresponds to the direction in which the axis A1 extends. For example, when a front end surface of the nose portion 21 is viewed from the outside, the axis A1 passes through a center of a tip portion 23 of the nose portion 21 and a center of gravity of the nose portion 21. The first pin hole 13 is formed on the nose portion 21.

Figure 5A:
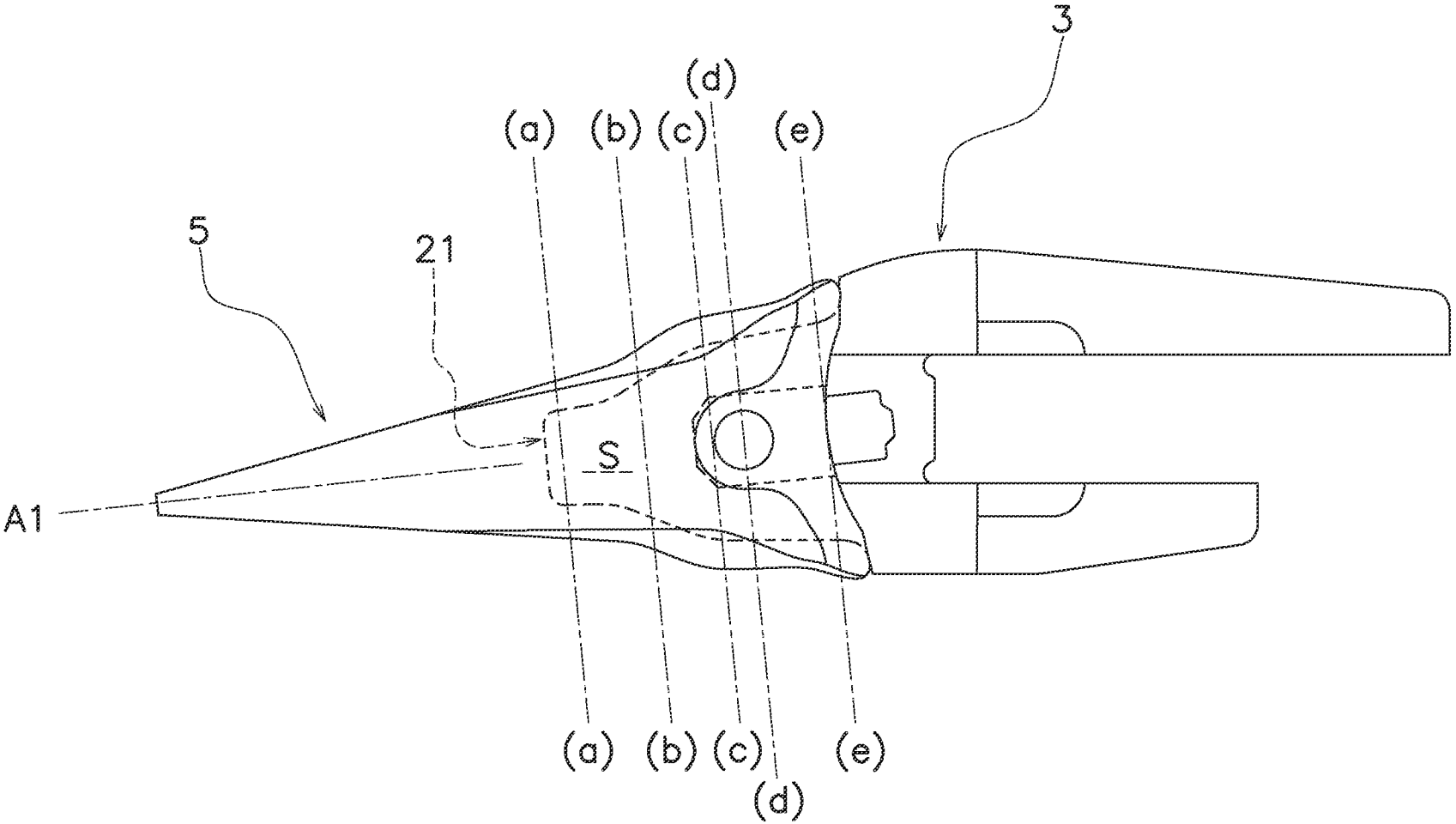
FIG. 5A is a side view of the tooth attachment structure in the embodiment.

As shown in FIG. 4A, the nose portion 21 includes a tip portion 23, a base end portion 25, and a connecting portion 27. As shown in FIG. 5A, the tip portion 23 is disposed in an internal space S of the tooth 5 so that the tip portion 23 abut on an inner surface of the tooth 5 in an axial direction in which the axis A1 of the nose portion 21 extends.

As shown in FIGS. 5A and 5B(a), an outer circumference of a cross section, which is obtained by cutting the tip portion 23 with the plane (a) orthogonal to the axis A1 of the nose portion 21, is formed in a rectangular shape. "The outer circumference" can be interpreted as "the outer shape". In the following, "a plane", which is orthogonal to the axis A1 of the nose portion 21, will be described as "a cutting plane".

As shown in FIG. 4A, the base end portion 25 is provided successively from the mounting portion 19. For example, the base end portion 25 is integrally formed with the mounting portion 19. As shown in FIGS. 5A and 5B(e), an outer circumference of a cross section, which is obtained by cutting the base end portion 25 with a cutting plane (e), is formed in a rectangular shape.

As shown in FIG. 5A, the connecting portion 27 is provided between the tip portion 23 and the base end portion 25. For example, the connecting portion 27 is integrally formed with the tip portion 23 and the base end portion 25. The first pin hole 13 is formed on the connecting portion 27.

An outer surface of the connecting portion 27 is formed in an octagonal shape. For example, each of outer circumferences of cross sections, which is obtained by cutting the connecting portion 27 by each of a cutting plane (b) and a cutting plane (c), is formed in an octagonal shape. An outer circumference of a cross section, which is obtained by cutting the connecting portion 27 with a cutting plane (d) passing through the first pin hole 13, is formed in an octagonal shape. A portion where the outer circumference of the cross section is formed in an octagonal shape is defined as the connecting portion 27.

More specifically, each of both ends of sides L1 facing each other on the connecting portion 27 forms a first ridgeline portion R1 which connects a corner portion of the base end portion 25 and a corner portion of the tip portion 23. For example, in the connecting portion 27, an octagonal side L1 is formed parallel to a plane P1 which includes the axis A1 of the nose portion 21 and an axis center A2 of the pin member 7. The plane parallel to the plane P1 on the connecting portion 27 is formed by the octagonal side L1. As shown in FIGS. 3, 4A, 5B(b), 5B(c), and 5B(d), the first ridgeline portion R1 is formed on an outer surface of the connecting portion 27 by both ends of the octagonal side L1.

Also, each of corner portions adjacent to both ends of the side L1 on the connecting portion 27 forms a third ridgeline portion R3 which connects a corner portion of the base end portion 25 and a corner portion of the tip portion 23. For example, as shown in FIGS. 3, 4A, 5B(b), 5B(c), and 5B(d), the third ridgeline portion R3 is formed on the outer surface of the connecting portion 27 by the corner portion adjacent to the corner portion forming the first ridgeline portion R1.

As shown in FIGS. 5B(b), 5B(c), and 5B(d), a side L3 adjacent to the side L1 of the connecting portion is a side of an octagonal outer circumference of the connecting portion 27. The side L3 forms a surface between the first ridgeline portion R1 and the third ridgeline portion R3.

As shown in FIGS. 5B(b), 5B(c), and 5B(d), a length of the side L1 at a center portion of the connecting portion 27 in the longitudinal direction (side L1 in FIG. 5B(c)) is shorter than a length of the side L1 on the base end portion 25 side of the connecting portion 27 (the length of the side L1 in FIG. 5B(d)). Also, a length of the side L1 at the center portion of the connecting portion 27 in the longitudinal direction (the length of the side L1 in FIG. 5B(c)) is a length of the side L1 on the tip portion 23 side of the connecting portion 27 (the length of the side L1 in FIG. 5B(b)).

Specifically, as shown in FIG. 3, the side L1 gradually becomes shorter from the base end portion 25 toward the center portion of the connecting portion 27 (see FIGS. 5B(d) and 5B(c)). Also, the side L1 gradually becomes longer from the center portion of the connecting portion 27 toward the tip portion 23 (see FIGS. 5B(c) and 5B(b)).

As shown in FIGS. 5B(b), 5B(c), and 5B(d), a length of the side L3 at the center portion of the connecting portion 27 in the longitudinal direction (the length of the side L3 in FIG. 5B(c)) is longer than a length of the side L3 on the base end portion 25 side of the connecting portion 27 (the length of the side L3 in FIG. 5B(d)). Also, a length of the side L3 at the center portion of the connecting portion 27 in the longitudinal direction (the length of the side L3 in FIG. 5B(c)) is longer than a length of the side L3 on the tip portion 23 side of the connecting portion 27 (the length of the side L3 in FIG. 5B(b)).

Specifically, as shown in FIG. 3, the side L3 gradually becomes longer from the base end portion 25 toward the center portion of the connecting portion 27 (see FIGS. 5B(d) and 5B(c)). Also, the side L3 gradually becomes shorter from the center portion of the connecting portion 27 toward the tip portion 23 (see FIGS. 5B(c) and 5B(b)).

(Tooth)

Figure 6:
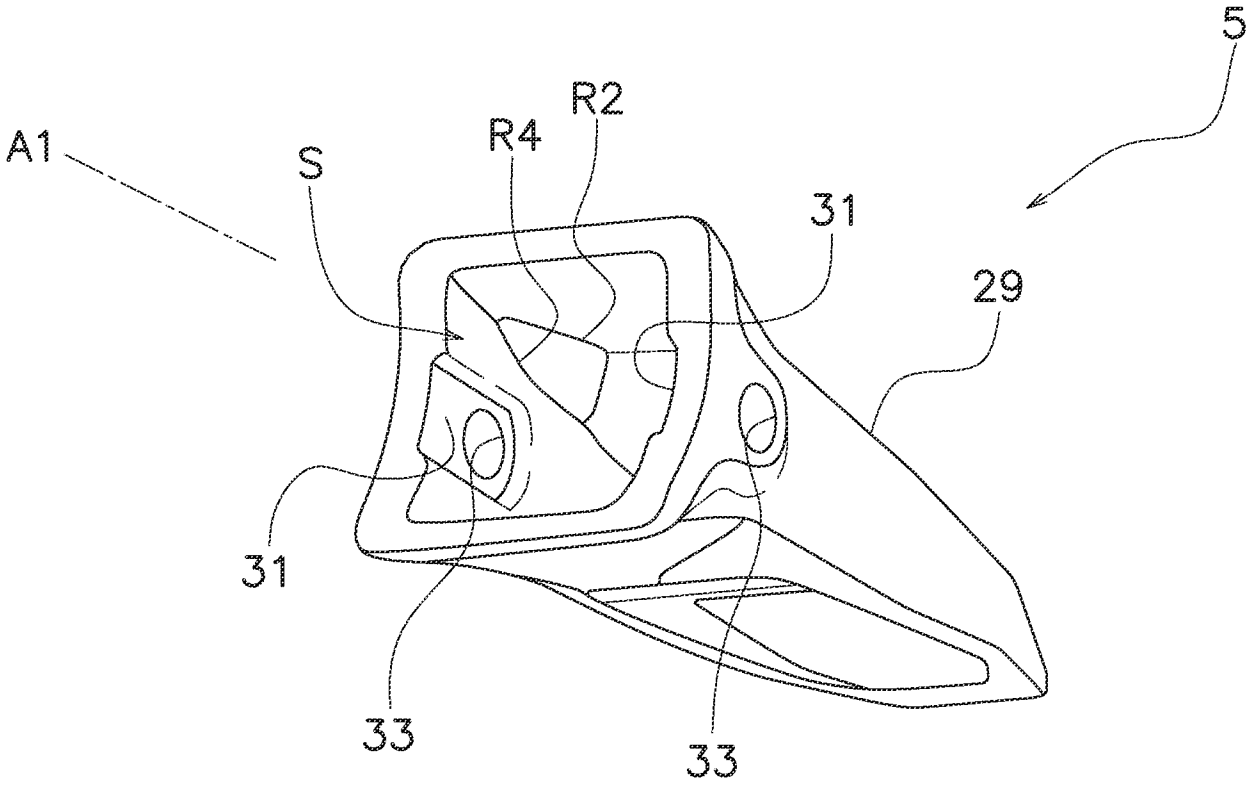
FIG. 6 is a perspective view of a tooth in the embodiment.

As shown in FIGS. 1, 2, and 5A, the tooth 5 is mounted to the tooth adapter 3. As shown in FIG. 6, the tooth 5 includes the internal space S for inserting the tooth adapter 3. The inner surface of the tooth 5 is formed along an outer surface of the tooth adapter 3. For example, the tooth 5 includes a guide groove 31 and a second pin hole 33 (an example of a through hole). Specifically, the tooth 5 includes a tooth body 29, the guide groove 31, and the second pin hole 33.

The tooth body 29 is formed in a bottomed cylinder shape. An inner surface of the tooth body 29 is formed along an outer surface of the nose portion 21. For example, the inner surface of the tooth body 29 is formed in a tapered shape. The internal space S is formed by forming the tooth body 29 in this way. The nose portion 21 of the tooth adapter 3 is disposed in the internal space S (see FIG. 5A).

The second pin hole 33 penetrates the tooth body 29. For example, the second pin hole 33 is formed on the tooth body 29 so as to communicate with the first pin hole 13 (see FIG. 4A). The second pin hole 33 is provided in the guide groove 31. The second pin hole 33 penetrates a bottom portion of the guide groove 31. The pin member 7 is disposed in the second pin hole 33.

The guide groove 31 is used for guiding the lock member 9 toward the pin member 7. The guide groove 31 is provided on the inner surface of the tooth 5. For example, the guide groove 31 is provided on the inner surface of the tooth body 29. The guide groove 31 extends from an open end of the tooth body 29 toward an tip of the tooth body 29. Specifically, the guide groove 31 extends from the open end of the tooth body 29 toward the tip of the tooth body 29 along the inner surface of the tooth body 29.

As shown in FIGS. 5A and 5B(a)-5B(e), an inner circumference of the cross section, which is obtained by cutting the tooth 5 with the each of cutting planes (a) to (e), is formed as follows.

As shown in FIGS. 5B(a)-5B(e), a portion facing the nose portion 21 on the tooth body 29 includes a first portion 35, a second portion 37, and a third portion 39.

As shown in FIG. 5B(a), the first portion 35 is a portion where the tooth body 29 faces the tip portion 23 of the nose portion 21. An inner surface of the first portion 35 is formed along an outer surface of the tip portion 23 of the nose portion 21. An inner circumference of a cross section, which is obtained by cutting the first portion 35 with the cutting plane (a), is formed in a rectangular shape. As shown in FIG. 5B(e), the second portion 37 is a portion where the tooth body 29 faces the base end portion 25 of the nose portion 21. An inner surface of the second portion 37 is formed along an outer surface of the base end portion 25 of the nose portion 21. An inner circumference of the cross section, which is obtained by cutting the second portion 37 with the cutting plane (e), is formed in a rectangular shape.

As shown in FIGS. 5B(b), 5B(c), and 5B(d), the third portion 39 is a portion where the tooth body 29 faces the connecting portion 27 of the nose portion 21. An inner surface of the third portion 39 is formed along an outer surface of the connecting portion 27 of the nose portion 21. For example, the inner circumference of the cross section, which is obtained by cutting the third portion 39 with each of the cutting plane (b), the cutting plane (c), and the cutting plane (d), is formed into an octagon.

In the third portion 39, an octagonal side L2 is formed parallel to the plane P1. As shown in FIGS. 6, 5B(b), 5B(c), and 5B(d), a second ridgeline portion R2 is formed on the inner surface of the third portion 39 by each of both ends of the octagonal side L2. The second ridgeline portion R2 is disposed so as to face the first ridgeline portion R1 (see FIG. 3) of the tooth adapter 3 (the connecting portion 27).

Also, a fourth ridgeline portion R4 is formed on an inner surface of the third portion 39 by a corner portion adjacent to the end portion of the side L2. The fourth ridgeline portion R4 is disposed so as to face the third ridgeline portion R3 (see FIG. 3) of the tooth adapter 3.

As shown in FIGS. 5B(b), 5B(c), and 5B(d), the side L4 adjacent to the side L2 of the third portion 39 is a side of an octagonal inner circumference of the third portion 39. The side L4 forms a surface between the second ridgeline portion R2 and the fourth ridgeline portion R4.

As shown in FIGS. 5B(b), 5B(c), and 5B(d), a length of the side L2 at a center portion of the third portion 39 in the longitudinal direction (the length of the side L2 in FIG. 5B(c)) is shorter than a length of the side L2 on the second portion 37 side on the third portion 39 (the length of the side L2 in FIG. 5B(d)). Also, a length of the side L2 at the center portion of the third portion 39 in the longitudinal direction (the length of the side L2 in FIG. 5B(c)) is shorter than a length of the side L2 on the first portion 35 side on the third portion 39 (the length of the side L2 in FIG. 5B(b)).

Specifically, as shown in FIG. 6, the side L2 gradually becomes shorter from the second portion 37 toward the center portion of the third portion 39 (see FIGS. 5B(d) and 5B(c)). Also, the side L2 gradually becomes longer from the center portion of the third portion 39 toward the first portion 35 (see FIGS. 5B(c) and 5B(b)).

As shown in FIGS. 5B(b), 5B(c), and 5B(d), the length of the side L4 of the center portion of the third portion 39 in the longitudinal direction (the length of the side L4 in FIG. 5B(c)) is longer than a length of the side L4 on the second portion 37 side on the third portion 39 (the length of the side L4 in FIG. 5B(d)). Also, a length of the side L4 at the center portion of the third portion 39 in the longitudinal direction (the length of the side L4 in FIG. 5B(c)) is longer than a length of the side L4 on the first portion 35 side on the third portion 39 (the length of the side L4 in FIG. 5B(b).

Specifically, as shown in FIG. 6, the side L4 gradually becomes longer from the second portion 37 toward the center portion of the third portion 39 (see FIGS. 5B(d) and 5B(c)). Also, the side L4 gradually becomes shorter from the center portion of the third portion 39 toward the first portion 35 (see FIGS. 5B(c) and 5B(b)).

The tooth 5 can be positioned with respect to the tooth adapter 3 by forming the second ridgeline portion R2 and the fourth ridgeline portion R4 on the inner surface of the tooth 5 and forming the first ridgeline portion R1 and the third ridgeline portion R3 on the tooth adapter 3. In other words, it is possible to suppress a backlash of the tooth 5 with respect to the tooth adapter 3.

(Pin Member)

As shown in FIG. 2, the pin member 7 connects the tooth adapter 3 and the tooth 5. The pin member 7 is disposed in the first pin hole 13 and the second pin hole 33. The pin member 7 is formed in a columnar shape. The pin member 7 can be formed in a cylindrical shape. The pin member 7 includes the axis center A2.

Figure 4C:
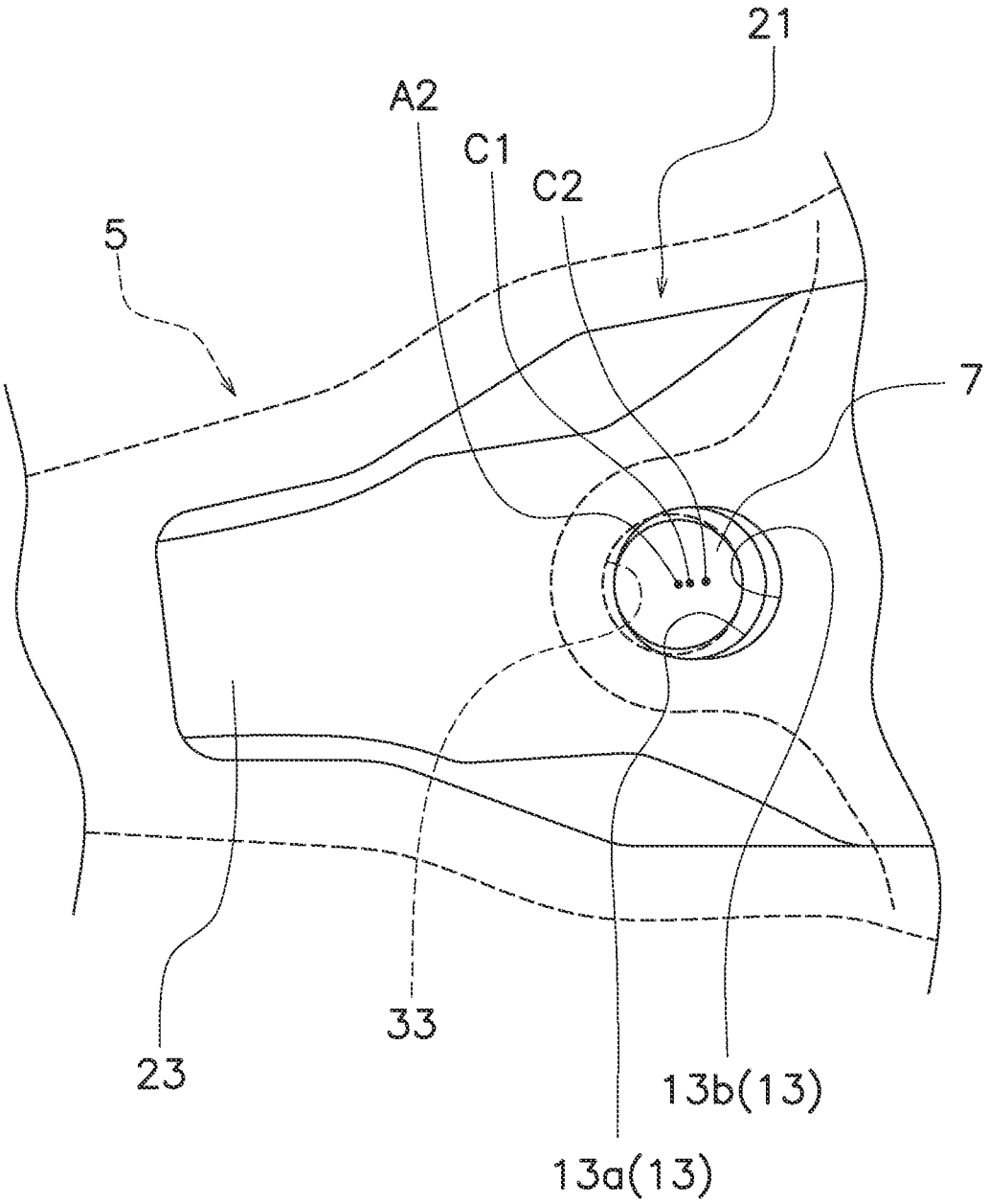
FIG. 4C is a side view which shows a positional relationship of a pin member and a pin hole in the embodiment.

For example, as shown in FIG. 4C, the pin member 7 is disposed in the first pin hole 13 and the second pin hole 33 in a state where the tip portion 23 of the nose portion 21 contacts with the inner surface of the tooth adapter 3. In this state, the pin member 7 contacts with an inner peripheral surface of the first pin hole 13 on the tip portion 23 side of the nose portion 21. Also, the pin member 7 contacts with an inner peripheral surface of the second pin hole 33 on the base end portion 25 side of the nose portion 21. In this state, the axis center A2 is offset from a center C1 of the center portion 13*a* and a center C2 of the end portion 13*b* of the first pin hole 13 toward the tip portion 23 side of the nose portion 21.

The pin member 7 includes an annular groove 7*a*. The annular groove 7*a* is formed on an outer peripheral surface of the pin member 7. The annular groove 7*a* is disposed between the tooth adapter 3 and the tooth 5. The lock member 9 engages with the annular groove 7*a*. Specifically, an engaging portion 41*a* (described later) of the lock member 9 engages with the annular groove 7*a*.

With this configuration, a gap is formed between the pin member 7 and the first pin hole 13 on the base end portion 25 side of the nose portion 21, in a state where the pin member 7 is disposed in the first pin hole 13 of the tooth adapter 3 and the second pin hole 33 of the tooth 5. This gap regulates so that the pin member 7 don't contact with a portion of the base end portion 25 side of the first pin hole 13 during an excavating work and a penetrating work with the bucket 2. Thereby, a durability of the pin member 7 and the first pin hole 13 can be improved.

(Lock Member)

Figure 7A:
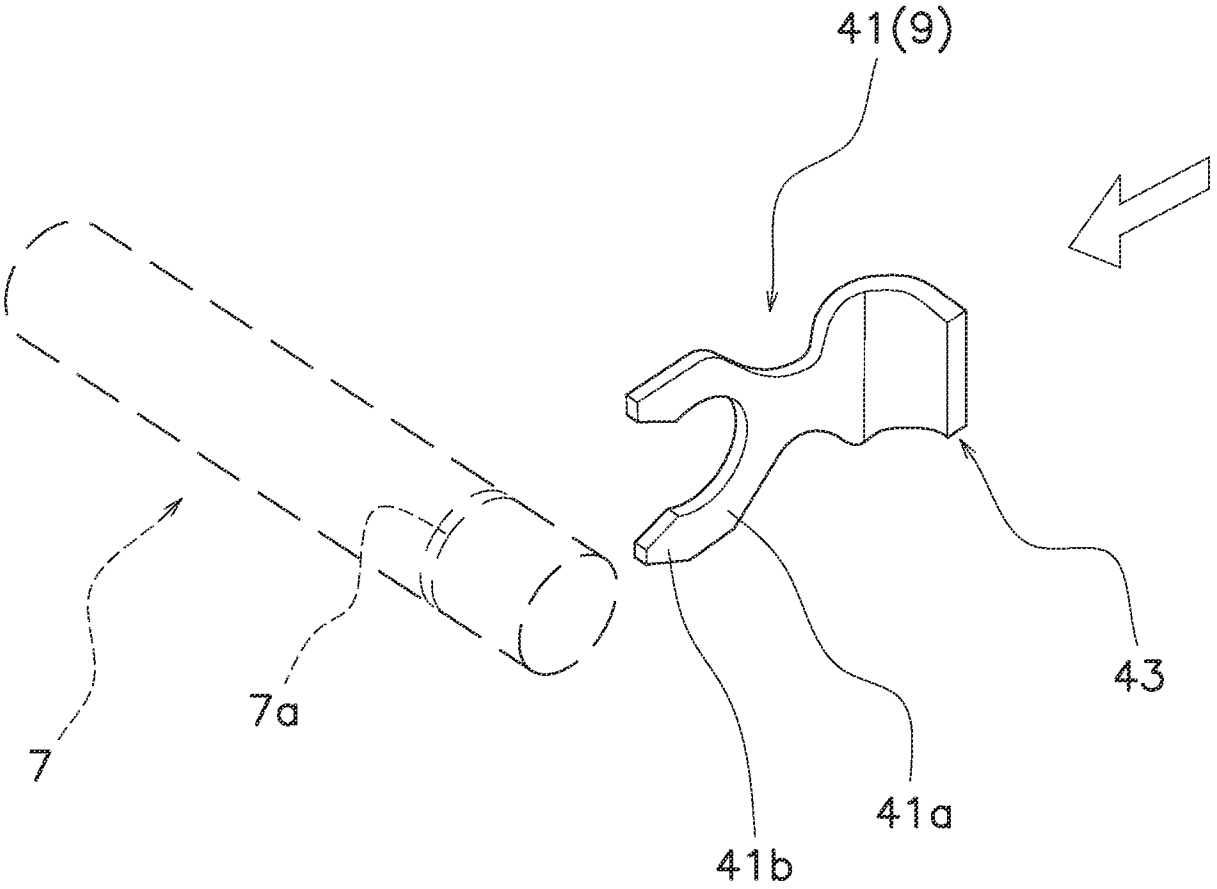
FIG. 7A is a perspective view of a lock member in the embodiment.

The lock member 9 is used for locking the pin member 7. As shown in FIG. 7A, the lock member 9 engages with the pin member 7 by sliding toward the pin member 7. Specifically, the lock member 9 engages with the pin member 7 by sliding in a direction toward the pin member 7. More specifically, the lock member 9 engages with the pin member 7 by sliding in a direction from the bucket 2 toward the pin member 7.

Figure 8A:
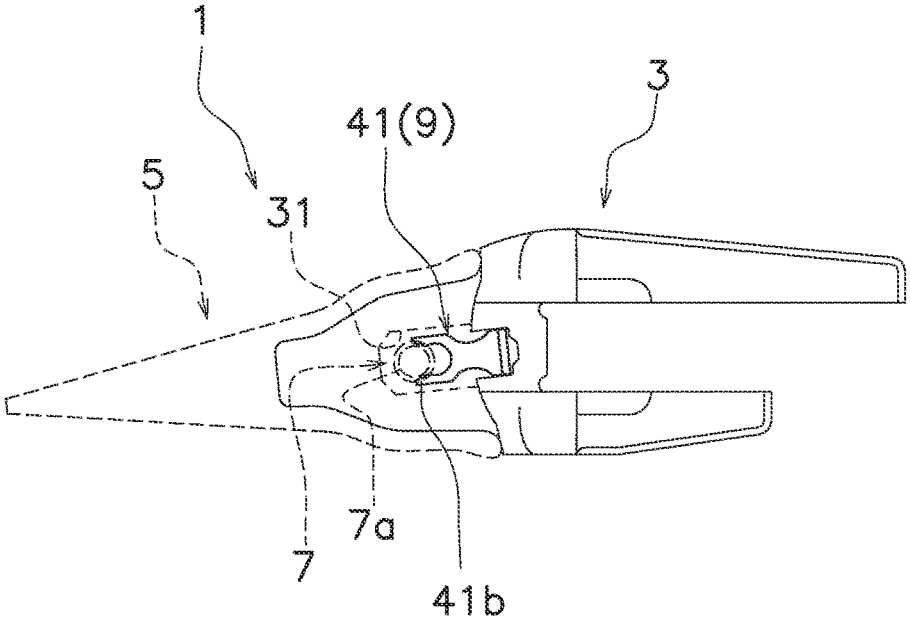
FIG. 8A is a side view of the tooth attachment structure in the embodiment (a unlocked state).

The lock member 9 is disposed between the tooth adapter 3 and the tooth 5. Specifically, the lock member 9 is disposed between an outer surface of the adapter body 11 and the inner surface of the tooth body 29. The lock member 9 is disposed in the guide groove 31 (see FIG. 8A). The lock member 9 includes a lock body 41 and a claw portion 43.

For example the lock body 41 is a rectangular plate-shaped member. The lock body 41 includes the engaging portion 41*a* and an opening portion 41*b*. The engaging portion 41*a* is a portion that engages with the pin member 7. The engaging portion 41*a* includes a C-shaped inner peripheral surface. The engaging portion 41*a* is fitted into the annular groove 7*a* of the pin member 7. The opening portion 41*b* is a portion that guides the pin member 7 toward the engaging portion 41*a*. A distance between opening ends in the opening portion 41*b* is larger than the diameter of the annular groove 7*a* of the pin member 7.

Figure 7B:
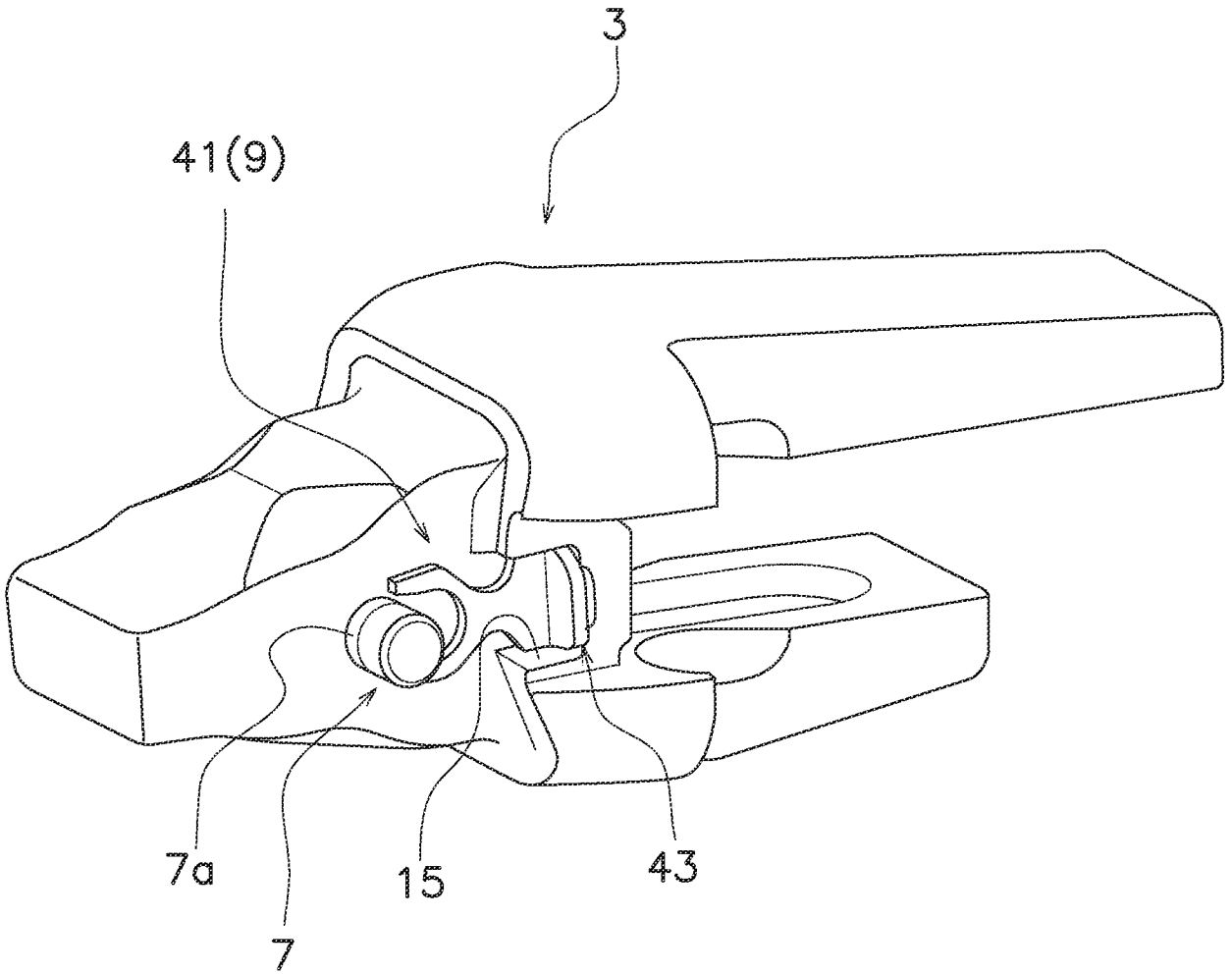
FIG. 7B is a perspective view of a state where the lock member and the pin member are disposed on the tooth adapter in the embodiment.

As shown in FIG. 7A, the claw portion 43 is a portion which protrudes from the lock body 41. For example, the claw portion 43 is formed integrally with the lock body 41. As shown in FIG. 7B, the claw portion 43 is disposed in the recess portion 15 of the tooth adapter 3.

The lock member 9 is mounted as follows. First, the lock member 9 is disposed on the tooth adapter 3. For example, the lock body 41 is disposed on the outer surface of the adapter body 11. Specifically, the opening portion 41*b* is disposed at the position of the first pin hole 13 of the adapter body 11. The claw portion 43 is disposed in the recess portion 15 of the adapter body 11.

Next, the tooth 5 is mounted to the tooth adapter 3. After that, the pin member 7 is inserted into the second pin hole 33 of the tooth body 29 and the first pin hole 13 of the adapter body 11. The annular groove 7*a* of the pin member 7 is disposed so as to face the opening portion 41*b* of the lock body 41 (see FIG. 8A). This state is a state where the lock member 9 and the pin member 7 are disengaged (an unlocked state).

Figure 8B:
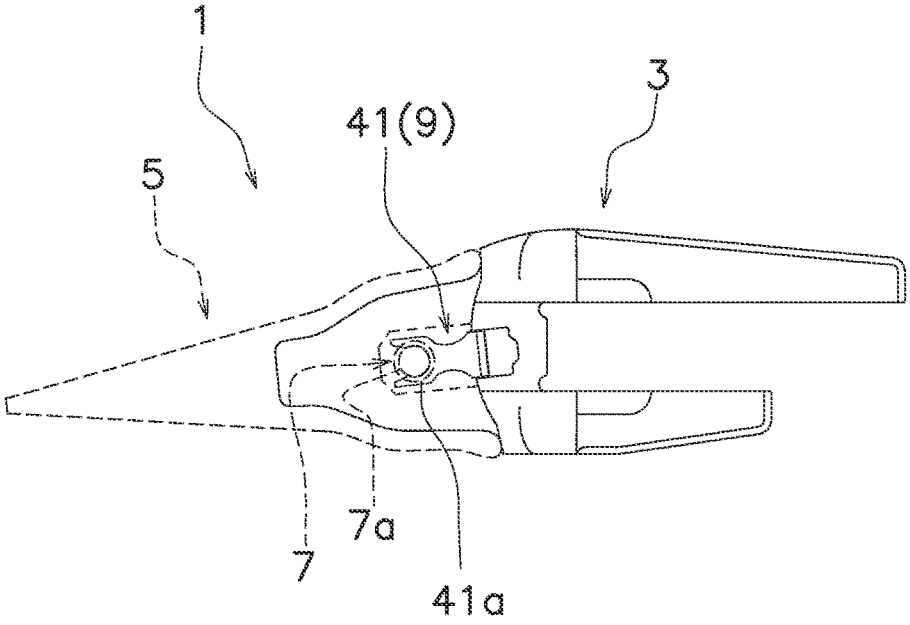
FIG. 8B is a side view of the tooth attachment structure in the embodiment (a locked state).

In this unlocked state, the claw portion 43 is pressed toward the pin member 7. Thereby, the lock body 41 slides toward the pin member 7, and the engaging portion 41*a* of the lock body 41 fits into the annular groove 7*a* of the pin member 7 (see FIG. 8B). This state is a state where the lock member 9 and the pin member 7 are engaged (a locked state).

In this way, the pin member 7 is locked by sliding the lock member 9 toward the pin member 7 in the unlocked state. Also, the pin member 7 is unlocked by sliding the lock member 9 in the direction away from the pin member 7 in the locked state.

(Variation A)

Figure 9A:
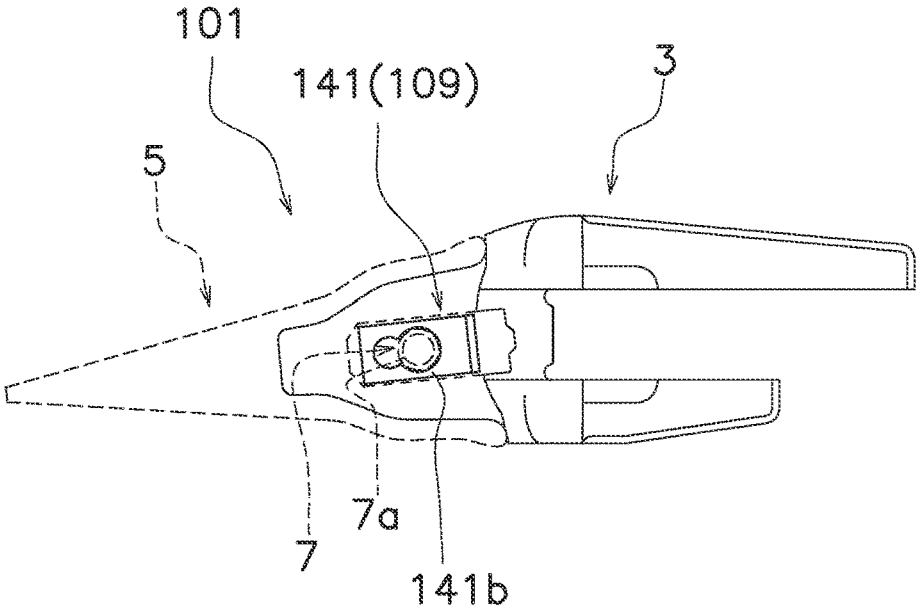
FIG. 9A is a side view of the tooth attachment structure in a variation A of the embodiment (the unlocked state).
Figure 9B:
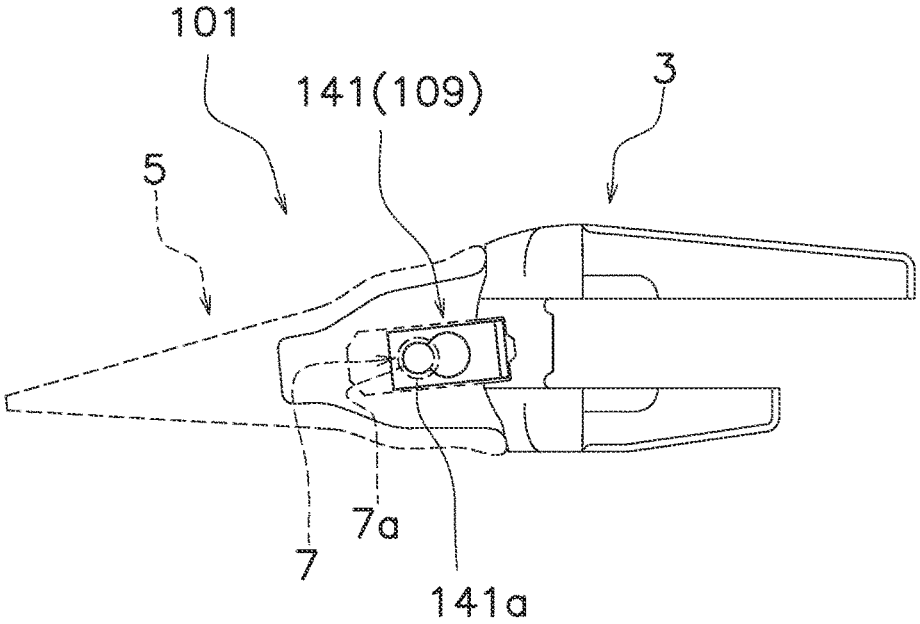
FIG. 9B is a side view of the tooth attachment structure in the variation A of the embodiment (the locked state).

In the above embodiment, an example is shown in which the lock member 9 engages with the pin member 7 by sliding in the direction from the bucket 2 toward the pin member 7. Instead of this configuration, a tooth attachment structure 101 can be configured as shown in FIGS. 9A and 9B. The configuration whose description is omitted here is the same as the configuration of the above embodiment.

In this case, as shown in FIGS. 9A and 9B, a lock member 109 engages with the pin member 7 by sliding in the direction away from the pin member 7. For example, the lock member 109 engages with the pin member 7 by sliding in the direction from the pin member 7 toward the bucket 2. The lock member 109 includes a lock body 141 and the claw portion 43. The configuration of the claw portion 43 is the same as the configuration of the above embodiment.

Figure 9C:
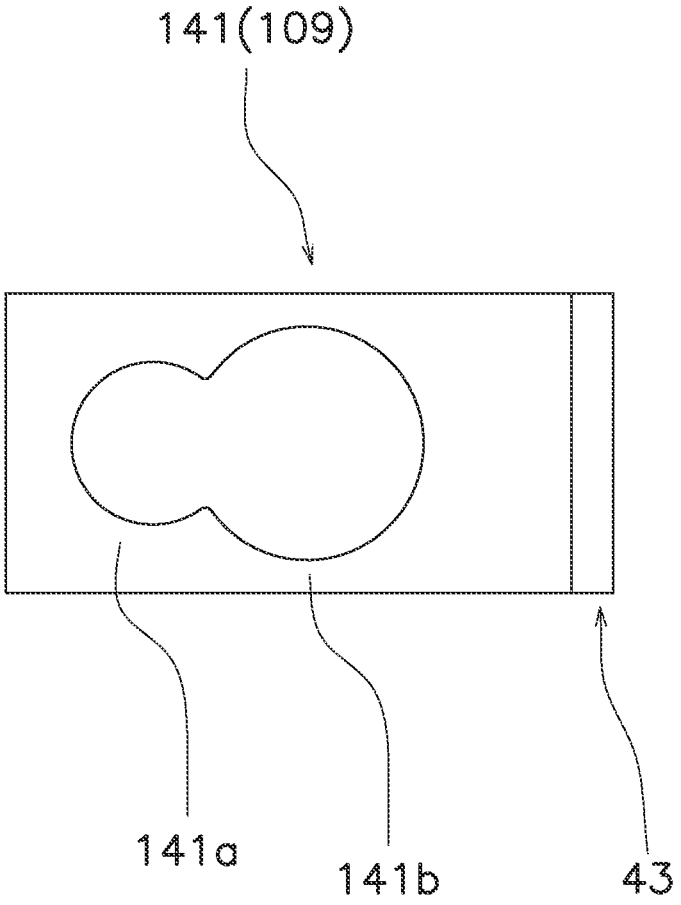
FIG. 9C is a side view of a lock member in the variation A of the embodiment.

As shown in FIG. 9C, for example, the lock body 141 is formed in a rectangular plate shape. The lock body 141 includes an engaging portion 141*a* and an opening portion 141*b*. The engaging portion 141*a* is a portion that engages with the pin member 7. The engaging portion 141*a* includes a C-shaped inner peripheral surface. The engaging portion 141*a* is fitted into the annular groove 7*a* of the pin member 7.

The opening portion 141*b* is a portion where the pin member 7 is disposed before the pin member 7 is engaged with the engaging portion 141*a*. The opening portion 141*b* is provided between the engaging portion 141*a* and the claw portion 43. The opening portion 141*b* includes a C-shaped inner peripheral surface. A diameter of the opening portion 141*b* is larger than the diameter of the pin member 7.

The lock member 109 is mounted as follows. First, the lock member 109 is disposed on the tooth adapter 3. For example, the lock body 141 is disposed on the outer surface of the adapter body 11. The opening portion 141*b* is disposed at the position of the first pin hole 13 of the adapter body 11.

Next, the tooth 5 is mounted to the tooth adapter 3. After that, the pin member 7 is inserted into the second pin hole 33 of the tooth body 29, the opening portion 141*b* of the lock member 109, and the first pin hole 13 of the adapter body 11. The annular groove 7*a* of the pin member 7 is disposed so as to face the opening portion 141*b* of the lock body 41 (see FIG. 9A). This state is a state where the lock member 109 and the pin member 7 are disengaged (the unlocked state).

In this unlocked state, the claw portion 43 is pressed toward the bucket 2. Thereby, the lock body 141 slides in a direction away from the pin member 7. As a result, the engaging portion 141*a* of the lock body 141 fits into the annular groove 7*a* of the pin member 7 (see FIG. 9B). This state is a state where the lock member 109 and the pin member 7 are engaged (the locked state).

In this way, the pin member 7 is locked by sliding the lock member 9 in the direction away from the pin member 7 in the unlocked state. Also, the pin member 7 is unlocked by sliding the lock member 9 in the direction toward the pin member 7 in the locked state.

(Variation B)

Figure 10A:
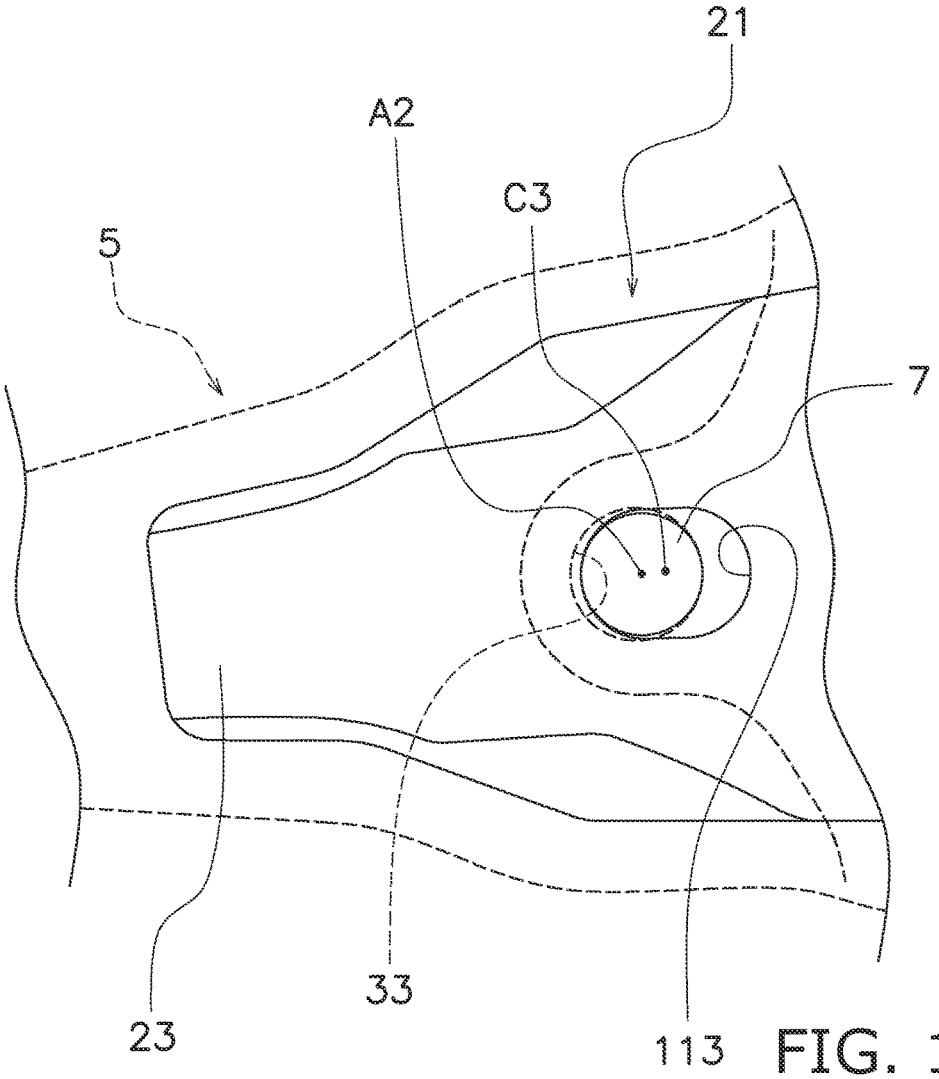
FIG. 10A is a side view which shows a positional relationship of a pin member and a pin hole in a variation B of the embodiment.
Figure 10B:
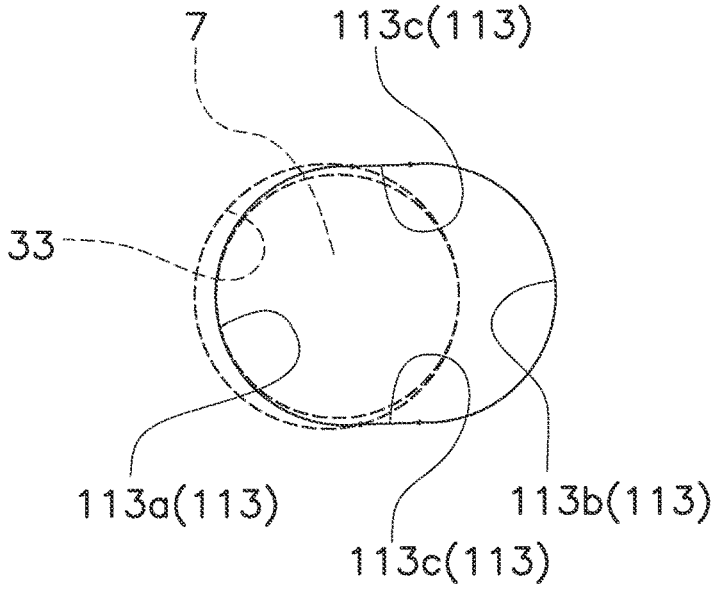
FIG. 10B is a partially enlarged side view of the pin hole in the variation B of the embodiment.

In the above embodiment, an example is shown in which the inner peripheral surface of the first pin hole 13 is expanded in diameter (see FIGS. 4B and 4C). Instead of this configuration, as shown in FIGS. 10A and 10B, an inner peripheral surface of a first pin hole 113 can be formed with a non-expanded diameter. The configuration whose description is omitted here is the same as the configuration of the above-described embodiment.

In this case, for example, as shown in FIGS. 10A and 10B, the inner peripheral surface of the first pin hole 113 is formed in an elongated hole shape. As shown in FIG. 10B, a first inner peripheral surface 113*a* of the first pin hole 113, which is formed on the tip portion 23 side of the nose portion 21, is formed in an arc shape. A radius forming the first inner peripheral surface 113*a* is larger than a radius of the pin member 7.

A second inner peripheral surface 113*b* of the first pin hole 113, which is formed on the base end portion 25 side of the nose portion 21, is formed in an arc shape. A radius forming the second inner peripheral surface 113*b* is larger than a radius of the pin member 7. A distance (a major axis) between the first inner peripheral surface 113*a* and the second inner peripheral surface 113*b* is larger than the diameter of the pin member 7.

A pair of third inner peripheral surfaces 113*c*, which is formed between the first inner peripheral surface 113*a* and the second inner peripheral surface 113*b*, is formed in a planar shape. The distance (a minor axis) of the pair of third inner peripheral surfaces 113*c* is larger than the diameter of the pin member 7.

In this case, as shown in FIG. 10A, the pin member 7 is disposed in the first pin hole 113 and the second pin hole 33 in a state where the tip portion 23 of the nose portion 21 contacts with the inner surface of the tooth adapter 3. In this state, the pin member 7 contacts with an first inner peripheral surface 113*a* of the first pin hole 113 on the tip portion 23 side of the nose portion 21. Also, the pin member 7 contacts with the inner peripheral surface of the second pin hole 33 on the base end portion 25 side of the nose portion 21. In this state, the axis center A2 is offset from a center C3 of the first pin hole 113 toward the tip portion 23 side of the nose portion 21. The center C3 of the first pin hole 113 is an intersection of the major axis and the minor axis.

With this configuration, a gap is formed between the pin member 7 and the first pin hole 113 on the base end portion 25 side of the nose portion 21, in a state where the pin member 7 is disposed in the first pin hole 113 of the tooth adapter 3 and the second pin hole 33 of the tooth 5. This gap regulates so that the pin member 7 don't contact with a portion of the base end portion 25 side of the first pin hole 113 during an excavating work and a penetrating work with the bucket 2. Thereby, a durability of the pin member 7 and the first pin hole 113 can be improved.

Here, an example is shown in which the inner peripheral surface of the first pin hole 113 is formed by the first inner peripheral surface 113*a*, the second inner peripheral surface 113*b*, and the third inner peripheral surfaces 113*c*. The inner peripheral surface of the first pin hole 113 can be formed in any shape as long as the inner peripheral surface of the first pin hole 113 includes the elongated hole shape.

In the tooth attachment structure 1 and 101, the pin member 7 is mounted on the tooth 5 and the tooth adapter 3 in the unlocked state. Thereby, the pin member 7 can be easily mounted to the tooth 5 and the tooth adapter 3. Also, the pin member 7 is locked by the lock members 9 and 109 by sliding the lock members 9 and 109 in the unlocked state. Thereby, the tooth 5 can be easily mounted to the tooth adapter 3 by the lock members 9 and 109 and the pin member 7.

On the other hand, the pin member 7 is unlocked by sliding the lock members 9 and 109 in the locked state. Thereby, the pin member 7 can be easily removed from the tooth 5 and the tooth adapter 3. Also, the tooth 5 can be easily removed from the tooth adapter 3.

As described above, in the tooth attachment structure 1 and 101, the tooth 5 can be easily mounted to and dismounted from the tooth adapter 3.

Although one embodiment of the present invention is described, the present invention is not limited to the above embodiment, and various variations can be made without departing from the scope of the invention.

In the above embodiment, a case is shown where the tooth attachment structure 1 and 101 is applied to the bucket 2. The tooth attachment structure 1 and 109 can be applied to a structure different from the bucket 2. For example, the tooth attachment structure 1 and 109 can be applied not only to the bucket 2 but also to a bucket shroud, a ripper point, and the like.

In the above embodiment, an example is shown in which the diameter of the first pin hole 13 is expanded. The first pin hole 13 is formed with the same diameter in an axial direction in which the axis center A2 of the pin member 7 extends.

Figure 11A:
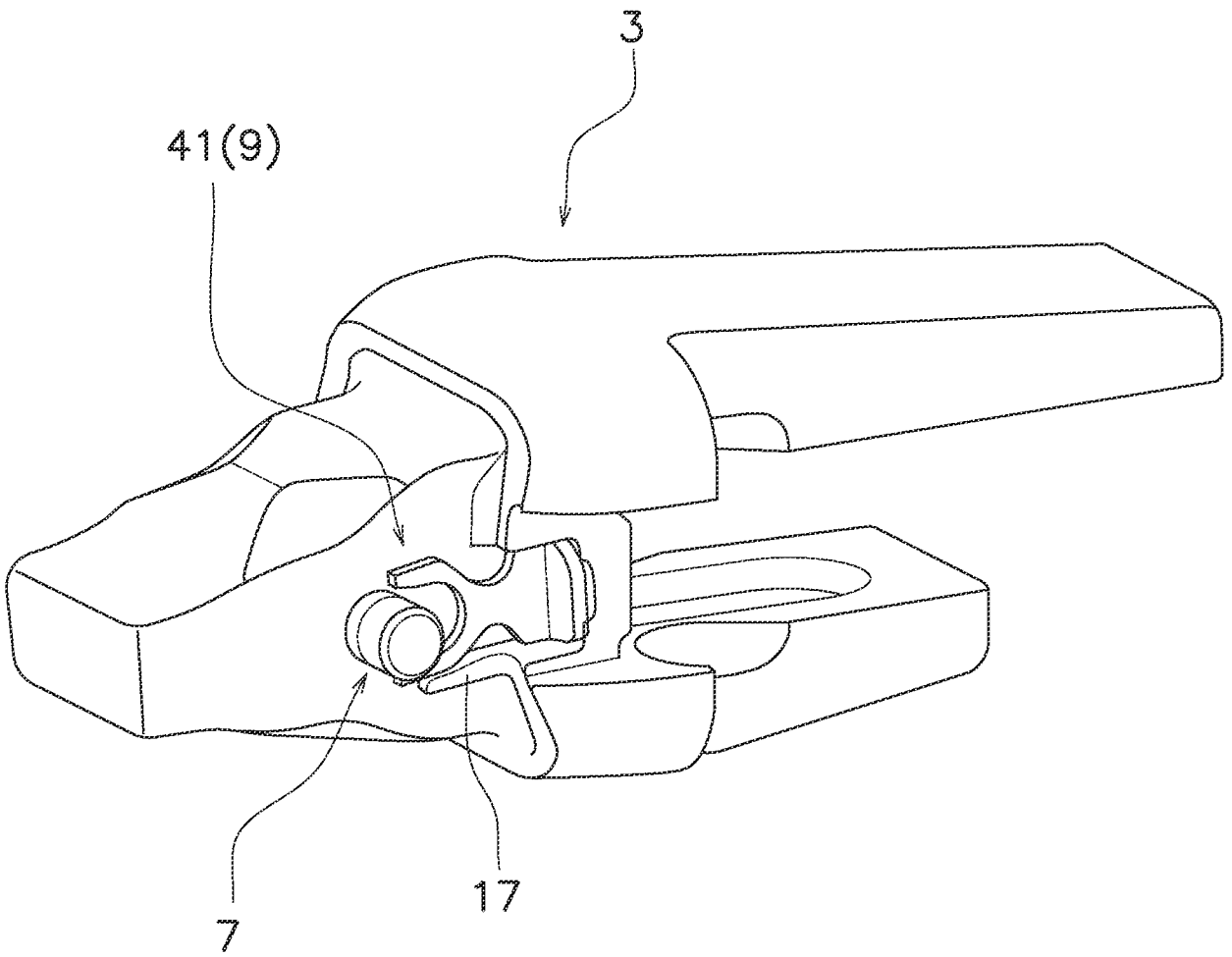
FIG. 11A is a perspective view of a state where a pin member and a lock member are disposed on the tooth adapter in the other embodiment.
Figure 11B:
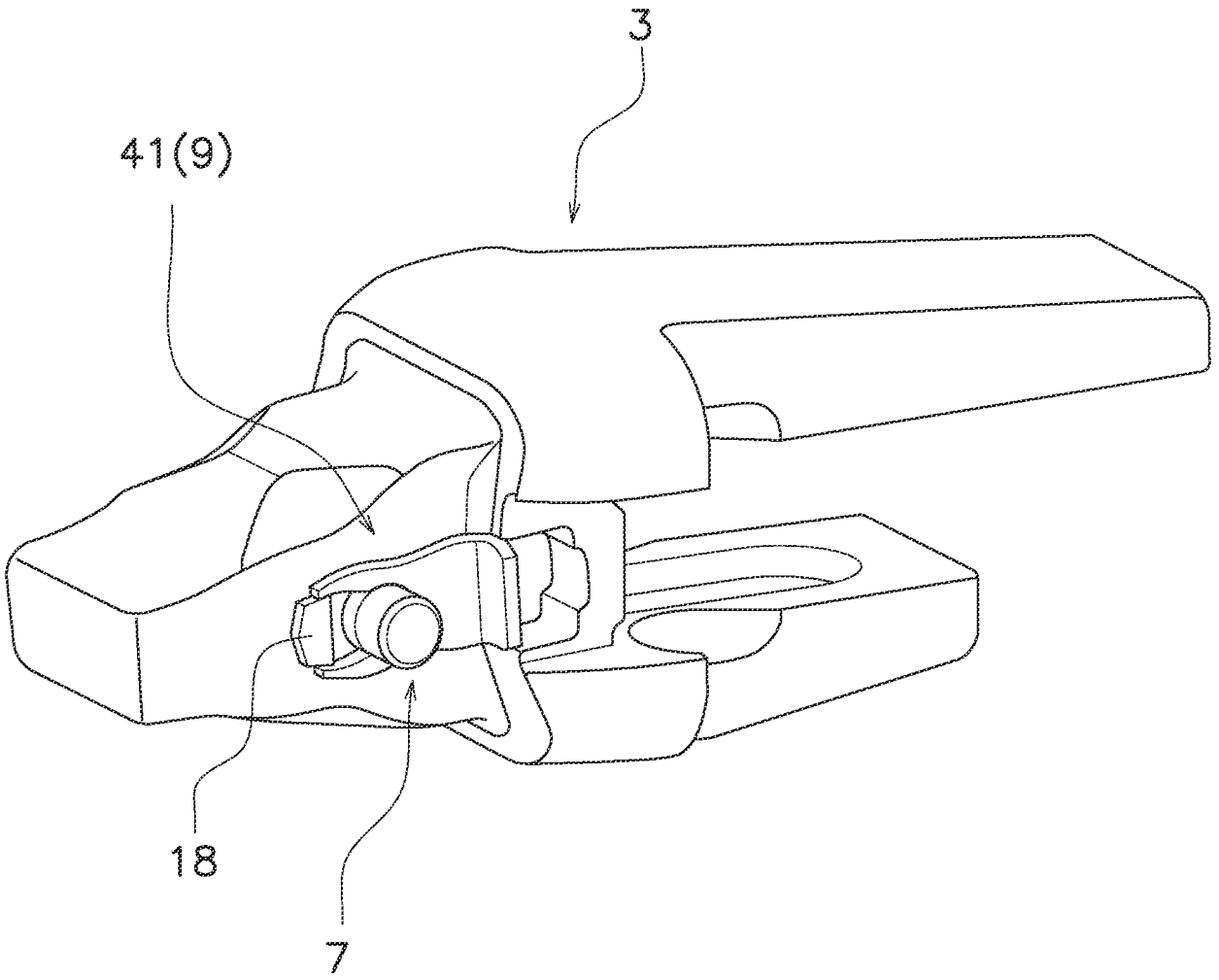
FIG. 11B is a perspective view of the state where the pin member and the lock member are disposed on the tooth adapter in the other embodiment.

In the above embodiment, an example is shown in which the tooth attachment structure 1 and 109 for the bucket 2 does not include a configuration for positioning the lock member 9. As shown in FIGS. 11A and 11B, the tooth attachment structure 1 and 109 for the bucket 2 can includes a configuration for positioning the lock member 9.

In this case, for example, the tooth adapter 3 further includes protrusions 17 and 18. The protrusions 17 and 18 are provided on the outer surface of the tooth adapter 3. For example, the protrusions 17 and 18 are formed on the outer surface of the nose portion 21.

The protrusion 17 of FIG. 11A supports the lock member 9, for example, the lock body 41 in the unlocked state. In a state where the tooth 5 is disposed on the tooth adapter 3, the protrusion 17 is disposed in the guide groove 31 of the tooth 5. The lock member 9 can be easily positioned with respect to the tooth adapter 3 by providing the protrusion 17 on the tooth adapter 3.

The protrusion 18 of FIG. 11B engages with a lock member 9, for example, a lock body 41 in the locked state. In a state where the tooth 5 is disposed in the tooth adapter 3, the protrusion 18 is disposed in the guide groove 31 of the tooth 5. The lock member 9 can be easily positioned with respect to the tooth adapter 3 by providing the protrusion 18 on the tooth adapter 3. The tooth attachment structure 1 and 109 for the bucket 2 can include both configurations of FIGS. 11A and 11B.

According to the present invention, a tooth can be easily mounted and dismounted.

Tooth Attachment Structure

What is claimed is:

1. A tooth attachment structure for a bucket comprising:

a tooth including an internal space, a guide groove provided on an inner surface, and a pin hole provided in the guide groove;

a pin member disposed in the pin hole; and a lock member disposed in the guide groove, the lock member engaging the pin member by sliding toward the pin member and locking the pin member.

2. The tooth attachment structure for the bucket according to claim 1, wherein the pin hole penetrates a bottom portion of the guide groove.

3. The tooth attachment structure for the bucket according to claim 1, wherein the lock member engages the pin member by sliding in a direction toward the pin member.

4. The tooth attachment structure for the bucket according to claim 1, wherein the lock member engages the pin member by sliding in a direction away from the pin member.

5. The tooth attachment structure for the bucket according to claim 1, wherein the lock member includes an engaging portion which engages the pin member.

6. The tooth attachment structure for the bucket according to claim 5, wherein the lock member further includes an opening portion which guides the pin member to the engaging portion.

7. The tooth attachment structure for the bucket according to claim 5, wherein the lock member further includes a claw portion.

8. The tooth attachment structure for the bucket according to claim 5, wherein the pin member includes an annular groove engaged by the engaging portion.

9. The tooth attachment structure for the bucket according to claim 1, further comprising a tooth adapter provided on the bucket and disposed in the internal space of the tooth;

the locking member engaging the pin member between the tooth adapter and the tooth.

10. The tooth attachment structure for the bucket according to claim 9, wherein a recess portion for disposing the lock member is formed on an outer surface of the tooth adapter.

11. The tooth attachment structure for the bucket according to claim 9, wherein the tooth adapter includes a through hole in which the pin member is disposed; and an end portion of the through hole includes a larger diameter than a center portion of the through hole.

12. The tooth attachment structure for the bucket according to claim 9, wherein the tooth adapter includes a protrusion for positioning the lock member.

13. A tooth for a bucket comprising:

a tooth body including an internal space;

a guide groove provided on an inner surface of the tooth body; and a pin hole provided in the guide groove, the guide groove including a wall portion and a bottom portion, an entire inner surface of the pin hole being spaced from the wall portion of the guide groove, and the bottom portion of the guide groove being formed between the entire inner surface of the pin hole and the wall portion of the guide groove.

14. The tooth for the bucket according to claim 13, wherein the pin hole penetrates a bottom portion of the guide groove.

* * * * *